US007507886B2

(12) United States Patent
Starr

(10) Patent No.: US 7,507,886 B2
(45) Date of Patent: Mar. 24, 2009

(54) STRING INSTRUMENTS

(76) Inventor: Jonathan Starr, 46 Sudbury Rd., Concord, MA (US) 01742

( * ) Notice: Subject to any disclaimer, the term of this patent is extended or adjusted under 35 U.S.C. 154(b) by 0 days.

(21) Appl. No.: 11/893,962

(22) Filed: Aug. 20, 2007

(65) Prior Publication Data

US 2009/0049976 A1 Feb. 26, 2009

(51) Int. Cl.
*G10D 3/00* (2006.01)

(52) U.S. Cl. ..... 84/291

(58) Field of Classification Search ..... 84/267, 84/290, 291

See application file for complete search history.

(56) References Cited

U.S. PATENT DOCUMENTS

| | | | | | |
|---|---|---|---|---|---|
| 26,043 | A * | 11/1859 | Knutsen | ..... | 2/127 |
| 5,994,633 | A * | 11/1999 | Norton | ..... | 84/290 |
| 6,376,756 | B1 * | 4/2002 | Beckmeier | ..... | 84/293 |
| 6,667,431 | B1 | 12/2003 | Norman | | |

* cited by examiner

*Primary Examiner*—Kimberly R Lockett
(74) *Attorney, Agent, or Firm*—Lambert & Associates; Gary E. Lambert; Adam J. Bruno

(57) ABSTRACT

A stringed instrument including an arm extending besides the strings from the body to the headstock such that said arm supports the tensions of the tuned strings, thereby eliminating the need for a neck to support this tension, and allowing for the use of fingerboards of a wide range of shapes which greatly improves ergonomic properties of the instrument.

20 Claims, 2 Drawing Sheets

STRING INSTRUMENTS

BACKGROUND OF THE INVENTION

1. Field of the Invention

This invention relates generally to the field of musical instruments, and more particularly to electric guitars and electric basses, wherein such instruments are made with a variety of ranges of pitches that can be produced with varying numbers of strings, typically as few as four or as many as twelve. The present invention applies to all of these variations.

2. Description of the Related Art

Presently, such instruments as an electric guitar include a body and headstock that connect on opposite ends of a strong neck connecting the body and headstock. The typical electric guitar also includes a fingerboard having a plurality of strings attached which comprises either the upper surface of the neck or a separate piece fastened securely to the upper surface of the neck. In either case, the neck bears the tension of the strings, which is quite considerable, and therefore necessitates the use of a neck having sufficient thickness and strength to bear this tension. In addition, it is generally necessary to install one or more adjustable truss rods within the neck to counter the tension of the strings, which otherwise would force the neck to bend unacceptably.

Thus, in the above-mentioned design of an electric guitar, the shape of the neck is constrained by the necessity to bear the tension of the strings. Moreover, even adjusting the distance between the strings and the fingerboard, which is an important characteristic to a player, is cumbersome. Furthermore, a user wishing to change to a different neck, on the electric guitar, to enjoy different playing styles, using either a fretted or fretless fingerboard, will encounter a nearly impossible situation without having to partially rebuild the instrument.

Some of the prior art cited below addresses part of these problems, but these references do so in relatively cumbersome ways, requiring at a minimum an individual to detach the strings from the neck and retuning to the instrument when the replacement is complete.

U.S. Pat. No. 7,081,575, to Pieper, Jr., discloses a stringed instrument that has a neck attached to the instrument body using a locking system which allows the neck to be detached and reattached.

U.S. Pat. No. 7,012,180, to Koeppe, Jr., discloses an apparatus and method for extending and retracting frets of a stringed musical instrument comprising a fret cylinder which engages a slidable rod which extends from the head stock through the neck to the instrument body. The rod is slidable, allowing the frets to be extended and retracted, by a handle attached to a gear shaft attached to a gear which engages the rod teeth on the rod. Moving the handle causes the gear to rotate which moves the rod.

U.S. Pat. No. 6,965,066, to Lace, discloses an elongated string support for a stringed instrument that reduces the stress on the player's wrists.

U.S. Pat. No. 6,667,431, to Norman, discloses a stringed instrument including extending body portions which extend lengthwise pass the neck and attach to the strings to prevent the neck from being stressed by the strings.

U.S. Pat. No. 6,376,756, to Beckmeier, discloses a stringed musical instrument with a neck with designed grooves to allow fingerboards to be switched on the instrument without removing the strings.

U.S. Pat. No. 6,111,175, to Lasner, discloses a neck having a composite material that can withstand the entirety of the tension of the strings without deformation or need for reinforcement.

U.S. Pat. No. 4,846,038, to Turner, discloses a neck structure for a stringed instrument which contains a graphite composite t-bar element.

U.S. Pat. No. 4,137,813, to Stone, discloses a stringed instrument with a neck with designed grooves to allow fingerboards to be switched on the instrument.

U.S. Pat. No. 4,132,143, to Stone, discloses a stringed instrument with a neck with designed grooves to allow different tonal scale fingerboards to be switched on the instrument.

One disadvantage of the aforementioned devices is that none of them claim that their design allows the fingerboard and/or neck to have any shape desired, within practical limits, due to the lack of tension on it.

Many of the devices mentioned above are constructed such that the neck must support the string tension in the above-described conventional way, while other devices do not possess removable fingerboards, allowing for quick and simple switching between fretted and fretless modes of play.

What is needed is the removal of the neck from the conventional electric guitar, and instead, simply constructing the fingerboard to be ergonomically ideal for each player. The removal of the neck brings in the use of an arm and an optional tension rod which can remove the tension-bearing use from a typical neck, leaving simply the fingerboard which may be adjusted to varying ergonomic properties allowing easy switching between fretted and fretless modes of play.

SUMMARY OF THE INVENTION

Therefore, what is required is an electric guitar wherein, the arm and the optional tension-resisting bar bear the tension of the strings, thus eliminating the necessity for a neck as used in the prior art. In the instant invention, the guitar possesses, only a fingerboard, which is attached at each end of the guitar and carries no tension.

It is an object of the instant invention to introduce a guitar containing an arm and a tension-resisting bar that bears the tension of the strings, thereby eliminating the neck from the overall structure of the guitar.

It is another object of the instant invention to introduce a guitar having a fingerboard carrying no tension, thereby allowing the fingerboard to be constructed of any shape, including a shape that is ergonomically desirable by the user since the fingerboard is not restricted by the tension which must be taken into account as in the prior art.

It is another object of the instant invention to introduce a guitar wherein the fingerboard can be attached to the body and the headstock in such a way that the distance between the fingerboard and the strings can be easily adjusted at each end. An additional object of the instant invention is that the fingerboard can be replaced with another easily, without affecting the tension of the strings. In this way, a player can switch between fretted and fretless playing, or easily try out a variety of fingerboards, allowing in either instance, for the elimination of an adjustable truss rod.

These improvements to the art will be apparent from the following description of the invention when considered in conjunction with the accompanying drawings wherein there has been outlined, rather broadly, the more important features of the improved musical instrument in order that the detailed description thereof that follows may be better understood, and in order that the present contribution to the art may be better appreciated.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

DETAILED DESCRIPTION OF THE SEVERAL AND PREFERRED EMBODIMENTS

The detailed description set forth below in connection with the appended drawings is intended as a description of presently-preferred embodiments of the invention and does not represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention, such as numerous string instruments.

Figure 1:
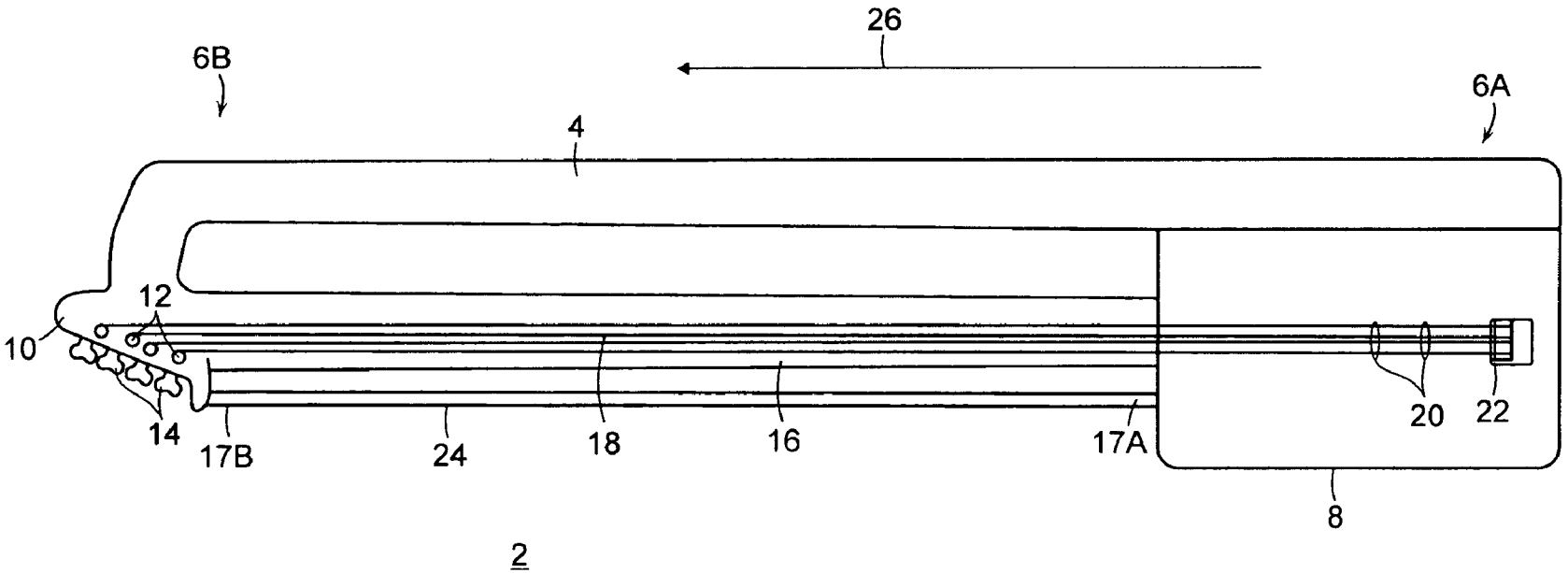
FIG. 1 depicts a top view of the guitar of the present invention.

FIG. 1 illustrates a guitar 2 of the present invention, wherein the guitar 2 includes an arm 4 having a first end 6A and a second end 6B. A body 8 is located at the first end of 6A of the arm 4 and a headstock 10 is located at the second end 6B of the arm 4, such that the arm 4 extends between the body 8 and the headstock 10. A plurality of string pegs 12 are located on the headstock 10, wherein each string peg 12 is adjusted by a like number of tuning keys 14. A fingerboard 16 having a first side 17A and second side 17B, wherein the fingerboard 16 is positioned and extendable between the body 8 located at the first end 6A and the headstock 10 located at the second end 6B of the arm 4 of the guitar 2. A plurality of strings 18 is extendable from the body 8 to the headstock 10, wherein the strings are attachable to the headstock by the string pegs 12. A plurality of pickups 20 is located on the body 8, wherein each pickup 20 is capable of converting the vibration of the nearby strings 18 into an electrical signal. Furthermore, a bridge 22 is located on the body 8, wherein the bridge 22 is positioned such that the plurality of strings 18 are fastened between the bridge 22 and the plurality of string pegs 12. Therefore, when the plurality of strings 18 are placed under sufficient tension to generate a musical tone, when the strings 18 of the guitar 2 are struck or plucked, the tension of the strings 18 are borne by a tension-resisting bar 24. The tension-resisting bar 24 is attachable between the body 8 and headstock 10 of the guitar 2 and possesses a sufficiently stiff construction, ensuring that the arm 4 does not bend when bearing the tension of the strings 18. Furthermore, the arm 4 of the guitar 2 is situated on a plane 26, defined as where the strings 18 pass through the arm 4, thereby preventing the arm 4 from flexing up or down relative to the plane 26 of the guitar 2 when the arm 4 bears the tension of the strings 18.

Figure 2:
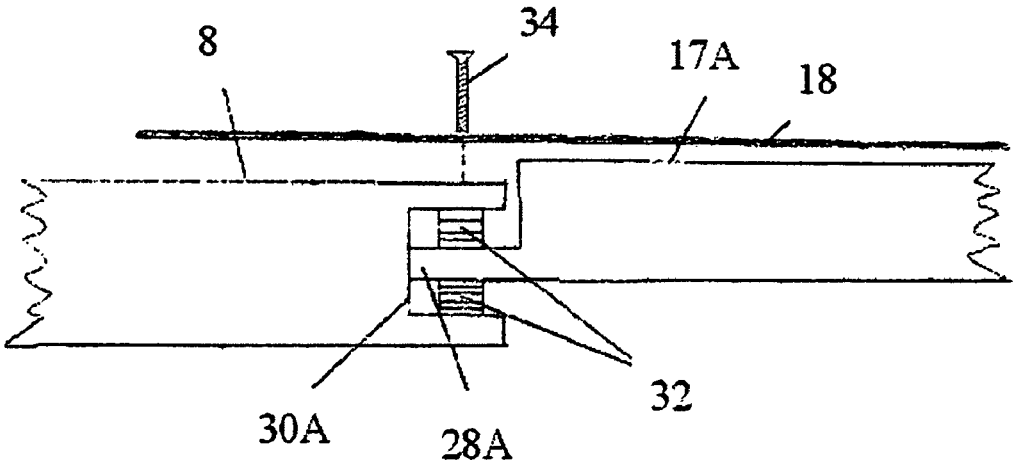
FIG. 2 depicts a side view of the fingerboard of the present invention, wherein the fingerboard is attached to the body of the guitar.
Figure 3:
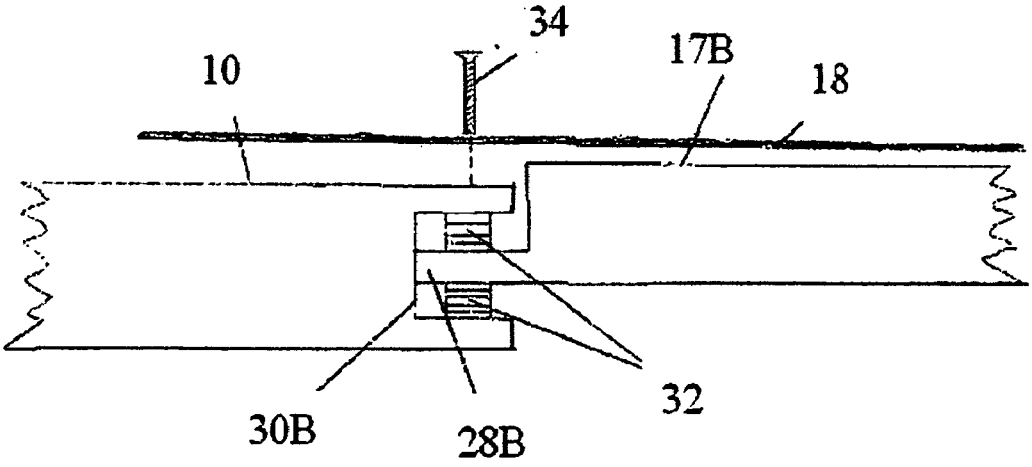
FIG. 3 depicts a side view of the fingerboard of the present invention, wherein the fingerboard is attached to the headstock of the guitar.

FIGS. 2 & 3 illustrate side views of the guitar 2, wherein the fingerboard 16 is shown attachable to the body 8 at the first end 6A of the arm 4 of the guitar 2, and wherein the fingerboard is attachable to the headstock 10 at the second end of the arm of the guitar. The fingerboard 16 further includes, a first tab 28A and a second tab 28B, wherein the first tab 28A is receivable by a first notch 30A located on the body 8, and wherein the second tab 28B is receivable by a second notch 30B located on the headstock 10. A plurality of shims 32 are placeable above and below the first tab 28A and the second tab 28B wherein the shims 32 are secured by a bolt 34 that passes through the first notch 30A or second notch 30B and either the first tab 28A or second tab 28B, enabling the fingerboard 16 to be attachable to the body 8 and the headstock 10. Similar means in attaching the fingerboard 16 to the body 8 and the headstock 10 may be used in addition to the above-described method. In addition, by varying the number, placement, and thickness of the shims 32, an individual is able to position the fingerboard 16 at whatever distance from the strings 18 the individual desires.

Although the present invention has been described with reference to particular embodiments, it will be apparent to those skilled in the art that variations and modifications can be substituted therefore without departing from the principles and spirit of the invention.

While several embodiments of the present invention have been illustrated by way of example, it is apparent that further embodiments could be developed within the spirit and scope of the present invention. However, it is to be expressly understood that such modifications and adaptations are within the spirit and scope of the present invention as set forth in the following appended claims.

I claim:

1. An improved string instrument comprising:

an arm having a first end and a second end;

a body attached to said first end of said arm;

a headstock attached to said second end of said arm, such that said arm extends from said body to said headstock;

a plurality of string pegs attached to said headstock;

a corresponding number of tuning keys to said string pegs attached to said headstock;

a fingerboard having a first side and a second side, wherein said fingerboard extends between said body and said headstock;

a plurality of pickups attached on said body capable of converting the vibration of nearby string into an electrical signal;

a bridge attached to said body such that strings are attached between said bridge and said string pegs such that when the strings are plucked, the tension creates a musical tone; and a plurality of strings extend from said body to said headstock, wherein the plurality of strings are attached to said string pegs located on said headstock and said bridge located on said body.

2. The improved string instrument of claim 1, wherein the arm bears the tension of the strings, thereby eliminating the need for a neck from the overall structure.

3. The improved string instrument of claim 1, wherein a tension-resisting bar extends between and is attached to said body and said headstock.

4. The improved string instrument of claim 3, wherein said tension-resisting bar is of sufficiently stiff construction to ensure that said arm does not bend when bearing the tension of the strings.

5. The improved string instrument of claim 1, wherein the fingerboard carries no tension, thereby allowing the fingerboard to be constructed of any shape.

6. The improved string instrument of claim 1, wherein said arm is placed such that a plane defined by said strings passes through said arm, such that said arm will not be caused to flex up or down relative to a plane of the string instrument when bearing the tension of said strings.

7. The improved string instrument of claim 1, wherein the fingerboard is removeably attached to said body and said headstock by a securement means.

8. The improved string instrument of claim 1, wherein said body further includes a first notch extending inwardly and wherein said headstock further includes a second notch extending inwardly.

9. The improved string instrument of claim 8, wherein said fingerboard further comprises:

a first tab extending outwardly from the first end and received in said notch located in said body;

a second tab extending outwardly from the second end and received in said notch located in said headstock;

a plurality of shims positioned above and below said first tab and said second tab.

10. The improved string instrument of claim 9, wherein said securement means is selected from the group consisting of a bolt, screw or nut, that is passed through said notch, said plurality of shims and said first tab or said second tab.

11. An improved guitar comprising:

an arm having a first end and a second end;

a body attached to said first end of said arm;

a headstock attached to said second end of said arm, such that said arm extends from said body to said headstock;

a plurality of string pegs attached to said headstock;

a corresponding number of tuning keys to said string pegs attached to said headstock;

a fingerboard having a first side and a second side, wherein said fingerboard extends between said body and said headstock;

a plurality of pickups attached on said body capable of converting the vibration of nearby string into an electrical signal;

a bridge attached to said body such that strings are attachable between said bridge and said string pegs such that when the strings are plucked, the tension creates a musical tone; and a plurality of strings extend from said body to said headstock, wherein the plurality of strings are attached to said string pegs located on said headstock and said bridge located on said body.

12. The improved string instrument of claim 11, wherein the arm bears the tension of the strings, thereby eliminating the need for a neck from the overall structure.

13. The improved string instrument of claim 11, wherein a tension-resisting bar extends between and is attached to said body and said headstock.

14. The improved string instrument of claim 11, wherein said tension-resisting bar is of sufficiently stiff construction to ensure that said arm does not bend when bearing the tension of the strings.

15. The improved string instrument of claim 11, wherein the fingerboard carries no tension, thereby allowing the fingerboard to be constructed of any shape.

16. The improved string instrument of claim 11, wherein said arm is placed such that a plane defined by said strings passes through said arm, such that said arm will not be caused to flex up or down relative to a plane of the string instrument when bearing the tension of said strings.

17. The improved string instrument of claim 11, wherein the fingerboard is removeably attached to said body and said headstock by a securement means.

18. The improved string instrument of claim 11, wherein said body further includes a first notch extending inwardly and wherein said headstock further includes a second notch extending inwardly.

19. The improved string instrument of claim 18, wherein said fingerboard further comprises:

a first tab extending outwardly from the first end and receivable in said notch located in said body;

a second tab extending outwardly from the second end and receivable in said notch located in said headstock;

a plurality of shims positionable above and below said first tab and said second tab.

20. The improved string instrument of claim 19, wherein said securement means is selected from the group consisting of a bolt, screw or nut, that is passable through said notch, said plurality of shims and said first tab or said second tab.

* * * * *